United States Patent [19]

Stumpp

[11] 4,134,379

[45] Jan. 16, 1979

[54] FUEL INJECTION SYSTEM

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 670,704

[22] Filed: Mar. 26, 1976

[30] Foreign Application Priority Data

Apr. 8, 1975 [DE] Fed. Rep. of Germany ..... 2515195

[51] Int. Cl.[2] ..... F02M 39/00; F02M 7/00

[52] U.S. Cl. ..... 123/139 AW; 261/44 A

[58] Field of Search ... 123/139 AW, 119 R, DIG. 14; 261/44 R, 44 A

[56] References Cited

U.S. PATENT DOCUMENTS

| | | | |
|---|---|---|---|
| 1,493,894 | 5/1924 | Reece | 261/44 A |
| 1,534,212 | 4/1925 | Hess | 261/44 A |
| 2,798,705 | 7/1957 | Lawrence | 261/44 R |
| 3,425,403 | 2/1969 | May | 123/139 AW |
| 3,447,519 | 6/1969 | Marcik | 123/119 R |
| 3,880,125 | 4/1975 | Kammerer | 123/119 R |
| 3,913,547 | 10/1975 | Wentworth | 123/139 AW |
| 4,015,571 | 4/1977 | Stumpp | 123/139 AW |

*Primary Examiner*—Ronald B. Cox
*Attorney, Agent, or Firm*—Edwin E. Greigg

[57] ABSTRACT

A fuel injection system for an internal combustion engine includes an air flow responsive baffle plate in the induction tube which is subject to an adjustable elastic restoring force. The pivotal shaft of the baffle plate rotates inside of a bushing which is itself adjustable rotatable within the induction tube. A control slot in the bushing is covered to varying extent by a control edge on the pivotal shaft so that fuel which enters a groove in the shaft is metered according to the relative rotation of shaft and bushing. The metered fuel is conducted through a conduit in the baffle plate and is expelled through a nozzle or a valve into the induction tube.

10 Claims, 4 Drawing Figures

FUEL INJECTION SYSTEM

BACKGROUND OF THE INVENTION

The invention relates to a fuel injection system for mixture compressing, externally ignited internal combustion engines. The type of engine to which this invention especially relates has an injection location in the air induction manifold which also includes an air flow measuring member as well as an arbitrarily actuatable throttle valve. The air flow rate meter may be displaced depending on the quantity of air flowing through the induction tube and it is subjected to a restoring force. During its displacement, the air measuring member controls a fuel metering system.

Fuel injection systems of this type are employed to obtain an automatic favorable adjustment of fuel-air mixture for all operational conditions of the engine so as to obtain complete combustion of fuel and the highest power or lowest fuel consumption. In addition, the concentration of toxic components in the exhaust gas is sharply reduced or entirely absent. This type of control requires that the fuel quantity be metered out very precisely according to the engine requirements.

In known fuel injection systems of this general type, the air quantity flowing through the induction tube is measured by an air flow rate meter and fuel is metered out proportional to the air quantity separately for each engine cylinder and is injected separately by individual injection valves in the vicinity of each cylinder. An embodiment of this type of fuel injection system is very expensive and complicated.

OBJECT AND SUMMARY OF THE INVENTION

It is a principal object of this invention to provide a fuel injection system similar to the known type but involving substantially lower constructional costs and providing a substantially improved fuel-air mixture while fulfilling the above-cited requirements made of such a fuel injection system.

This object is attained according to the invention, by providing that the fuel metering valve is disposed in the bearing shaft of the air flow rate measuring member which is embodied as a baffle plate. The invention further provides that the pressure difference accross the fuel metering location may be held constant by use of a differential pressure valve.

It is a favorable feature of the invention that the bearing shaft has a control edge which cooperates with a fuel control slot disposed in a bushing which may be rotated relative to the bearing shaft of the air measuring member. The invention further provides that, downstream of the fuel metering valve but prior to the injection of the fuel, air may be added to the fuel via an air line communicating with the air induction tube upstream of the measuring member.

It is a further favorable feature of the invention that the injection of fuel-air mixture takes place in a gap between the end face of the air measuring member and the wall of the air induction tube, by means of an injection nozzle or valve. The invention will be better understood as well as further objects and advantages thereof become more apparent from the ensuing detailed specification of a preferred embodiment taken in conjunction with the drawing.

DESCRIPTION OF THE PREFERRED EMBODIMENT

Figure 1:
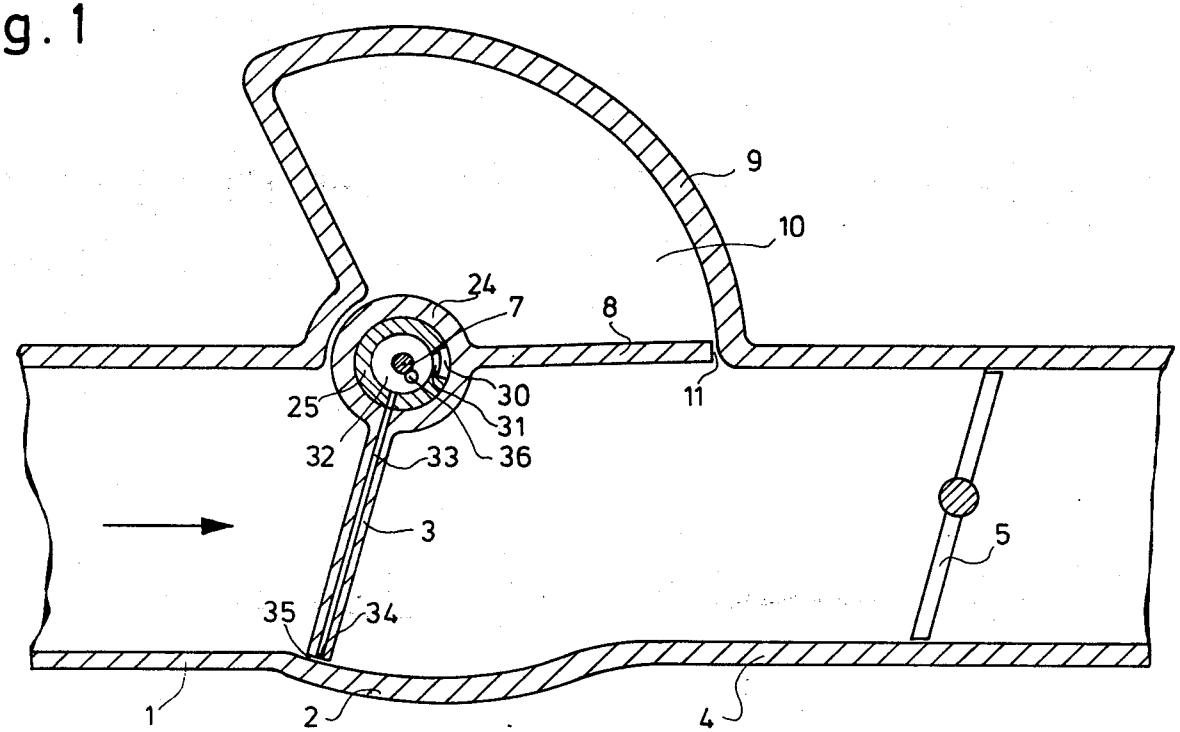
FIG. 1 is a sectional view of a fuel injection system according to the invention, along the line I—I in FIG. 2.

Turning now to FIG. 1, it will be seen that the air aspirated by the engine flows through an air induction tube 1, including a region 2, in which there is disposed an air flow rate measuring member 3 embodied as a baffle plate. The air then continues to flow through an induction tube region 4 including an arbitrarily actuatable throttle valve 5 and continues to one or more cylinders (not shown) of an internal combustion engine.

The air flow rate meter 3 rotates in a suitable region 2 of the induction tube 1 as an approximately linear function of the quantity of air flowing through the induction tube and, if the pressure upstream of the measuring member 3 is constant, then the pressure between the measuring member 3 and the throttle valve 5 also remains constant. The air flow meter 3 is mounted rotatably about a fixed bearing shaft 7 whose long axis lies transverse with respect to the direction of air flow and is provided with a damper flap 8. When the air flow meter 3 rotates, the damper flap 8 enters a damper region 9 of the induction tube. The chamber 10 formed by the damper flap 8 and the walls of the induction tube constituting the damper region 9 communicates through a small slit 11, between the end face of the damper flap and the wall of the damper region 9, with the interior of the induction tube downstream of the air flow meter 3. The presence of the damper flap 8 guarantees that induction tube pressure fluctuations due to the various suction strokes of the pistons have virtually no influence on the angular position of the air flow meter 3.

Figure 2:
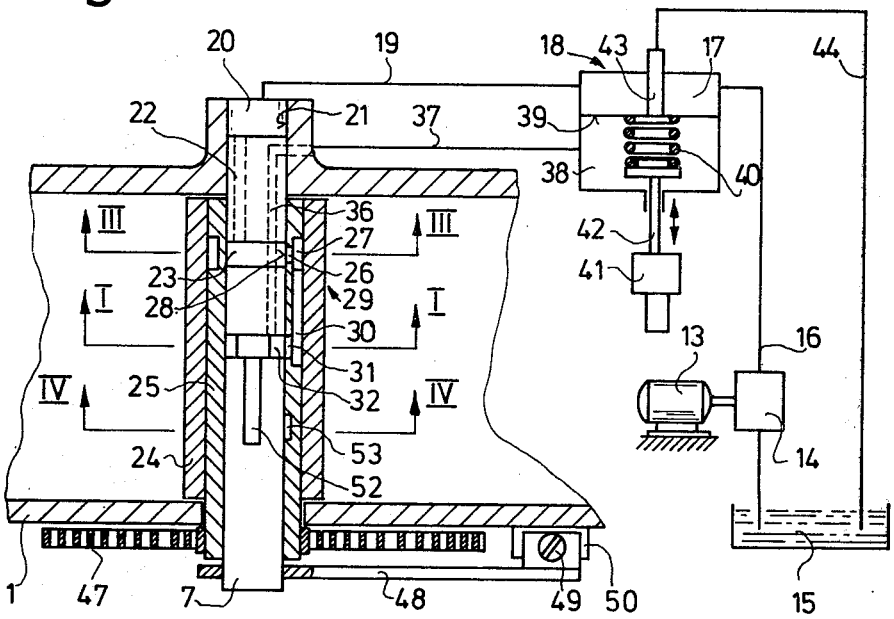
FIG. 2 is a top view of a fuel injection system according to the invention.
Figure 3:
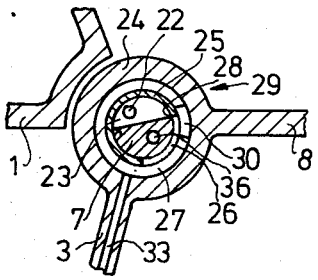
FIG. 3 is a sectional view of the fuel injection system according to the invention along the line III—III in FIG. 2.

Turning now to FIG. 2, it will be seen that fuel is supplied to the system by an electric motor 13 which drives a fuel pump 14 that aspirates fuel from a fuel container 15 and delivers it via a line 16 to a chamber 17 within a differential pressure valve 18. From the chamber 17, fuel flows through a line 19 into a chamber 20 which is defined by the end face of the bearing shaft 7 and its guide bore 21 in an extension of the induction tube wall. A bore 22, shown in broken lines in FIG. 2, establishes communication of the chamber 20 with a groove 23 worked into the bearing shaft 7. The air flow meter 3 and the damper flap 8 are both affixed on a sleeve 24 which is fixedly attached to a bushing 25 rotating on the bearing shaft 7. The bushing 25 has a control slot 26 terminating in an annular groove 27. The control slot 26 cooperates with a control edge 28 (see FIG. 3) which is formed by the end surface of the groove 23 in the bearing shaft. Depending on the position of the air flow meter 3, the control edge 28 opens the control slot 26 to varying degrees for metering out a fuel quantity proportional to the aspirated air flow rate. Thus, the control edge 28 and the control slot 26 together form a fuel metering valve 29 within the bearing shaft 7 of the air flow meter 3. The metered fuel flows from the annular groove 27 through a groove 30 and an opening 31 in the bushing 25 into an annular groove 32 in the bearing shaft 7. The annular groove 32 communicates with a line 33 disposed within the baffle plate of the air flow meter 3 and the line 33 opens at the terminal surface of the metering plate through an injection nozzle 34 into a gap 35 fomed between the metering member 3 and the wall of the induction tube 2 as best seen in FIG. 1. In a variant embodiment, which is not illustrated, the line 33 might terminate in several nozzles 34 located in the end surface of the air flow meter plate 3. As another variant, the injection nozzle 4 might be a slit extending nearly over the entire width of the end surface of the air measuring plate 3. In yet another embodiment, not illustrated, the injection nozzle 34 might be a fuel injection valve.

Fuel is metered out at the metering valve 29 with constant pressure difference. For this purpose, the annular groove 22 communicates through a bore 36 and a line 37 with a chamber 38 in the differential pressure valve 18 which is separated by a diaphragm 39 from the chamber 17. The differential pressure valve 18 is urged to close by a spring 40 within the chamber 38. The force of the spring 40 may be changed in dependence on operational parameters of the engine. For this purpose, an electromagnet 41 may, for example, be employed, which engages the spring 40 via an actuating pin 42 or, again, a supplementary force whose magnitude depends on engine variables may act directly on the diaphragm 39 in parallel with the spring 40. For example, the magnetic force may be made dependent on the engine temperature or on the signal from an oxygen sensor located in the exhaust line. The force of the spring 40 might also be made dependent on a bimetallic spring which engages it with a force depending on the engine temperature. The differential pressure valve 18 is embodied as a flat seat valve whose diaphragm 39 is its movable valve member which cooperates with a fixed valve seat 43 over which fuel may flow into a return line 44 which terminates in the fuel container 15. The differential pressure valve serves at the same time as a system pressure control valve.

The air which flows through the induction tube displaces the air flow meter 3 in opposition to the force of a helical spring 47 whose one end is connected with the bushing 25 and whose other end is attached to a stop in the induction tube. The basic setting of the fuel metering valve 29 may be adjusted by rotating the bearing shaft 7 with the aid of a lever 48 and an adjustment screw 49 which rests on a stop 50 attached to the housing.

Figure 4:
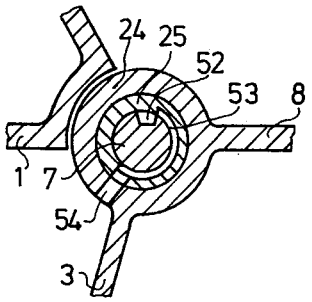
FIG. 4 is a partial section of the injection system along the line IV—IV in FIG. 2.

A very favorable feature of the invention is that the metered-out fuel is mixed with air prior to injection in the air induction tube. For this purpose, as shown more clearly in FIG. 4, the annular groove 32 communicates with an air hole 54 via a groove 52 and an annular groove 53. The air hole 54 leads to the interior of the air induction tube 1 upstream of the air flow meter 3. The annular groove 53 is preferably so embodied that it covers the groove 52 only when the engine runs at least a minimum idling rpm or else that the injection nozzle 34 is effectively shielded through a very narrow gap 35. This feature prevents the admission of an incombustible fuel-air mixture during engine start up. The admixture of air to the metered fuel prior to injection in the induction tube results in an improved mixture preparation.

The above-described fuel injection system according to the present invention operates as follows:

When the engine is running, the fuel pump 14 aspirates fuel from the container 15 and delivers it through the line 16 to the fuel metering valve assembly 29. At the same time, the engine aspirates air which flows through the induction tube 1 and imparts to the air flow meter 3 a certain displacement from its normal position. Depending upon this displacement of the air flow meter 3, the control slot 26 is opened to a higher or lower degree by the control edge 28. Since the fuel metering valve 29 is controlled directly by the air flow meter 3, the ratio of aspirated air and metered out fuel is constant. Furthermore, the fuel metering takes place at a pressure difference which is held constant by the differential pressure valve 18 while the force of the spring 40 and, hence, the pressure difference, may be changed so as to adapt the fuel-air ratio to different operational conditions of the engine. The metered-out fuel is injected through the injection nozzle 34 located at the end surface of the air flow meter 3 into the gap 35 as between the end surface of the air flow meter 3 and the interior wall of the region 2 of the induction tube, i.e., at a point where the air flow has its highest velocity, so as to obtain as hemogeneous a fuel-air mixture as possible. The contour of that part of the interior wall of the induction tube region 2 which cooperates with the end surface of the air flow meter 3 may be adapted to provide the desired fuel-air ratio.

The fuel injection system according to the present invention provides the advantage that the location of the fuel metering assembly 29 in the bearing shaft 7 makes possible a very compact construction and, furthermore, since the fuel injection occurs through the end surface of the air flow meter 3, all fuel lines may be made very short and a very good mixture integration is obtained. Yet another improvement of the fuel mixture preparation results from admixing air with the metered-out fuel prior to injection in the induction tube.

The foregoing description relates to a preferred embodiment of the invention and it is to be understood that numerous variants of this invention may be made within the spirit and scope of the invention, the latter being defined by the appended claims.

What is claimed is:

1. A fuel injection system for an internal combustion engine, said engine being of the spark-plug ignited type and including an air induction tube, comprising:

a bearing shaft extending through said air induction tube with its long axis extending transverse to the direction of air flow through said induction tube, a bushing rotatably mounted on said shaft in concentric relationship therewith, a baffle plate fixedly mounted on said bushing inside said induction tube for rotation with said bushing;

elastic means for urging said baffle plate to oppose the force exerted on it by the air flow through said induction tube;

said shaft and said bushing include cooperating fuel metering apertures for the flow of fuel therethrough, the quantity of fuel being metered depending on the relative opening provided by said cooperating apertures and being dependent on the amount of pivoting of said baffle plate due to the force of the air flowing in said induction tube, said baffle plate including conduit means or expelling said metered fuel into said induction tube, and a differential pressure valve for maintaining a constant fuel pressure difference across said metering apertures.

2. A fuel injection system as defined by claim 1, wherein said aperture in said bushing being a control slot which is variably obturated by a control edge on said shaft during relative rotation of said shaft and said bushing.

3. A fuel injection system as defined in claim 2, wherein said bushing has an air hole to provide air from upstream of said baffle plate to the interior of said bushing for admixture with metered fuel prior to expulsion through said conduit means.

4. A fuel injection system as defined in claim 3, wherein said hole is so located that it is obturated when said baffle plate is substantially in its normal, undisplaced position.

5. A fuel injection system as defined by claim 3, wherein the periphery of said baffle plate and the interior wall of said induction tube define a gap into which fuel is expelled from said conduit means.

6. A fuel injection system as defined in claim 5, further comprising at least one fuel injection nozzle coupled to said conduit means or expelling fuel into said gap.

7. A fuel injection system as defined by claim 5, further comprising a fuel injection valve disposed on said baffle plate for injection of metered fuel into said induction tube.

8. A fuel injection system as defined by claim 1, wherein said differential pressure valve is a flat seat diaphragm valve, the two sides of said diaphragm being affected, respectively, by fuel from upstream and downstream of said metering apertures and one side of said diaphragm being additionally affected by the force of spring means.

9. A fuel injection system as defined by claim 8, further including means for adjusting said spring means to provide a variable force, depending on operational variables of said internal combustion engine.

10. A fuel injection system as defined by claim 9, wherein said differential pressure valve is so connected as to control the fuel pressure in said fuel injection system.

* * * * *